US005080150A

United States Patent [19]

Deadwyler, Jr.

[11] Patent Number: 5,080,150

[45] Date of Patent: Jan. 14, 1992

[54] CONDIMENT BOTTLE DRAINING BASKET

[76] Inventor: Hugh A. Deadwyler, Jr., 1323 Bonnie La., Charlotte, N.C. 28213-3509

[21] Appl. No.: 688,670

[22] Filed: Apr. 22, 1991

[51] Int. Cl.[5] ..... B65B 3/06; B67C 9/00

[52] U.S. Cl. ..... 141/364; 141/86; 141/106; 141/367; 141/375; 220/571; 220/DIG. 6

[58] Field of Search ..... 141/86, 146, 363, 367, 141/364, 365, 366, 391, 319, 375; 220/571, 572, 9.1, 9.2, 489, 493, 532, DIG. 6

[56] References Cited

U.S. PATENT DOCUMENTS

| | | | |
|---|---|---|---|
| 205,665 | 7/1878 | Miller et al. | 141/106 |
| 421,754 | 2/1890 | Pannill | 141/106 |
| 746,159 | 12/1903 | Reeves | 220/572 |
| 1,710,588 | 4/1929 | Nagy | 141/106 X |
| 1,811,896 | 6/1931 | Ross | 220/571 X |
| 2,111,715 | 3/1938 | Winfree | 141/364 X |
| 3,117,692 | 1/1964 | Carpenter et al. | 220/532 |
| 3,853,159 | 12/1974 | Guerard | 141/364 |
| 3,964,636 | 6/1976 | Rehrig | 220/DIG. 6 X |
| 4,271,878 | 6/1981 | Bologa | 141/375 |
| 4,981,232 | 1/1991 | Wynn | 220/532 |

*Primary Examiner*—Ernest G. Cusick

[57] ABSTRACT

Condiment bottle draining baskets are housewares that allow consumers to drain up to five percent of catsup, thick salad dressing, barbecue sauce, etc. that otherwise can remain stuck in the bottom of bottles. These baskets let consumers invert and fully drain thick liquid condiment bottles so the product flows into the neck and against the inside of the cap ready for immediate use. In the preferred embodiment two baskets flex and hold small, medium, and large household size condiment bottles in an inverted position, one bottle per basket. These wide based baskets can then be placed on counters, in refrigerator doors, and on the dining table. As much as fiver percent of household thick liquid condiments can be reclaimed saving money and, ultimately, reducing the total number of containers thrown into landfills.

1 Claim, 3 Drawing Sheets

CONDIMENT BOTTLE DRAINING BASKET

TECHNICAL FIELD AND BACKGROUND OF THE INVENTION

This invention relates to recovering catsup, sauce and salad dressing that may otherwise remain stuck in the bottom of the bottle. Consumers often discard these condiment containers with as much as five percent of the product still left inside. Householders sometimes do access this remainder but only with difficulty, using such means as shaking or pounding on the bottom of bottles or awkwardly propping them upside down in their refrigerator door or trying to balance the bottle on its cap.

The solution, described in this application, is rectangular semi-flexible baskets with broad bases. Each size of a set of two baskets (a preferred embodiment) holds a wide range of shapes and sizes of common condiment bottles in an inverted position allowing all of the product to drain into the neck of the bottle for complete and immediate use once the cap is opened.

BACKGROUND OF THE INVENTION

It's human nature to want to utilize all of a product you pay for. Thick liquid condiments, like catsup, certain salad dressings, and various sauces, pose a special problem for the household consumer. Even plastic squeeze bottles generally don't help access the last five percent, or so, that is otherwise stuck and is often discarded at the bottom of the bottle. In an effort to drain the entire contents into the neck some consumers awkwardly prop these bottles upside down in their refrigerators. Others grasp the bottom of bottles and sling them in an arc trying to force the remainder contents free into the neck. Still others try to awkwardly balance the bottles upside down on their caps at the dinner table, risking an almost inevitable fall when the table is bumped.

Various products for draining thick liquid condiments, specifically catsup, have been posed and patented.

U.S. Pat. No. 4,271,878 discloses a device that holds various size bottles, in an inverted position, by the neck and drains the contents into a cup. Flexible support fingers hold various size necks centered in the aperture at the top of its stand.

U.S. Pat. No. 3,853,159 discloses a frame for holding an array of large restaurant size catsup bottles with an intervening funnelling arrangement that transfers the contents of these nearly empty bottles into one bottle located below.

U.S. Pat. No. 421,754 discloses an even more general draining mechanism that utilizes a tube and trough for receiving thick or tenacious liquids like molasses.

The inventions described above are more complex and unwieldy solutions than the condiment bottle draining baskets which are the objects of this claim. These baskets simply hold various household size bottles in an inverted position draining the contents into the neck and against the cap of the actual inverted containers themselves and therefore do not necessitate decanting the liquid into any other cup, through, or container like the prior examples. These baskets are handy in their embodiment and readily fit into the refrigerator.

SUMMARY OF THE INVENTION

Therefore, it is an object of the invention to provide convenient and near-complete draining of a variety of thick-liquid condiments packaged in various bottles.

It is another objective of the invention to allow consumers to save money on the purchase of bottled condiments—including catsup, sauce, and salad dressing—by draining most of the contents into the neck and against the cap of the container and therefore minimizing the amount of residual product discarded with the container.

It is yet another object of the invention to contribute to the environment by minimizing the waste of manufactured food products and by reducing the total number of containers thrown into landfills.

These and other objects of the present invention are achieved in the preferred embodiment, disclosed below, by putting a thick-liquid condiment bottle upside down in a rectangular semi-flexible plastic basket.

In order to illustrate how as few as two (and even one) specially designed plastic baskets can accommodate different sizes and shapes of consumer household condiment bottles, a discussion of the common features of all of these various containers is necessary.

Condiment bottles have several characteristics in common. Most all have a narrower neck that attenuates into the top and enlarges into a thicker cavity where the majority of the contents are stored. This neck portion can typically range up to half of the total height of the bottle. In order for the baskets to "flex" and "grab" the main cavity of an inverted bottle, the basket must "swallow" the total length of the neck and have at least one-third to one-half of the thick bottle cavity to flex against. This suggests optimum basket heights that will be stipulated in the "preferred embodiment and best mode" section of this narrative.

The thickness of the main bottle cavity compared to the basket opening width (suggested above) is an even simpler concept and is intuitively obvious. The thick dimension of the bottle cavity (from the front label to the back of the bottle) flexes the long sides of the basket's opening thus, effectively "grabbing and supporting" the bottle's sides. Also, in the completely pushed-in position, the bottle cap seats at the bottom of the basket's interior further contributing to the inverted bottle's stability in the holder.

According to one preferred embodiment of the invention a pair of (two) properly sized plastic baskets hold all commonly-sized small-to-large condiment bottles.

According to yet another preferred embodiment of the invention one highly elastic plastic basket holds all commonly-sized small-to-large condiment bottles.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
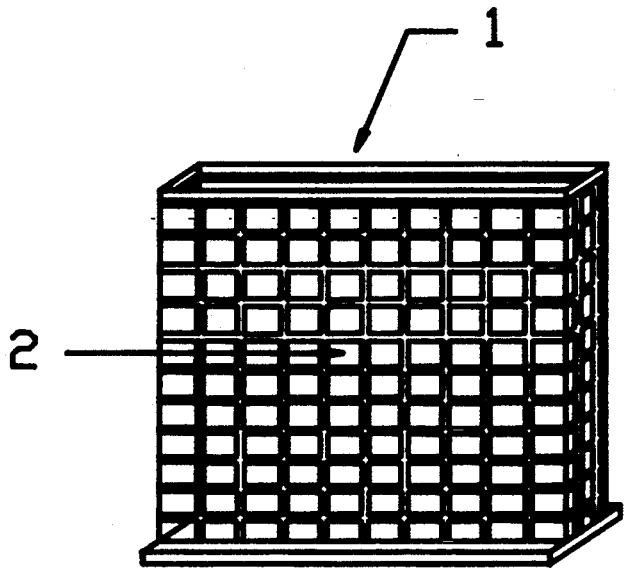
FIG. 1 is a perspective view of a long side and opening of a typical condiment bottle draining basket.
Figure 2:
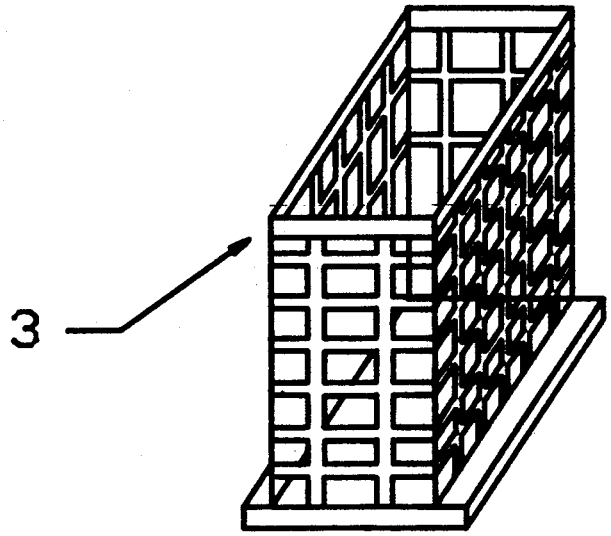
FIG. 2 is a view of the opening shown from a short side perspective.

Referring now specifically to the drawings, a condiment bottle draining basket, according to the present invention, is illustrated in FIGS. 1 and 2. Its rectangular shape is shown on the long dimension in FIG. 1 and on the short dimension in FIG. 2. The inverted condiment bottle is placed in the opening on FIG. 1 at reference numeral 1 causing the woven plastic sides to expand and conform to the main cavity of the bottle's body 2. Edge support ridges at the top and sides of the basket, FIG. 2 numeral 3, form a semi-ridged frame for positive support of the inverted bottle.

Most condiment bottles containing catsup, sauce, and salad dressing range in size from "small" (1⅝ inches thick, 7½ inches tall, and 4 inches wide) to "large" (4 inches thick, 11 inches tall, and 5½ inches wide.) From a basket design perspective we can place the full range of sizes (above) in two categories. The first category is "small-to-medium size condiment bottles." The second category is "medium-to-large size condiment bottles." In the basket-pair preferred embodiment the set is comprised of one "small basket" and one "large basket" designed to accommodate each of the two size categories above.

Figure 3:
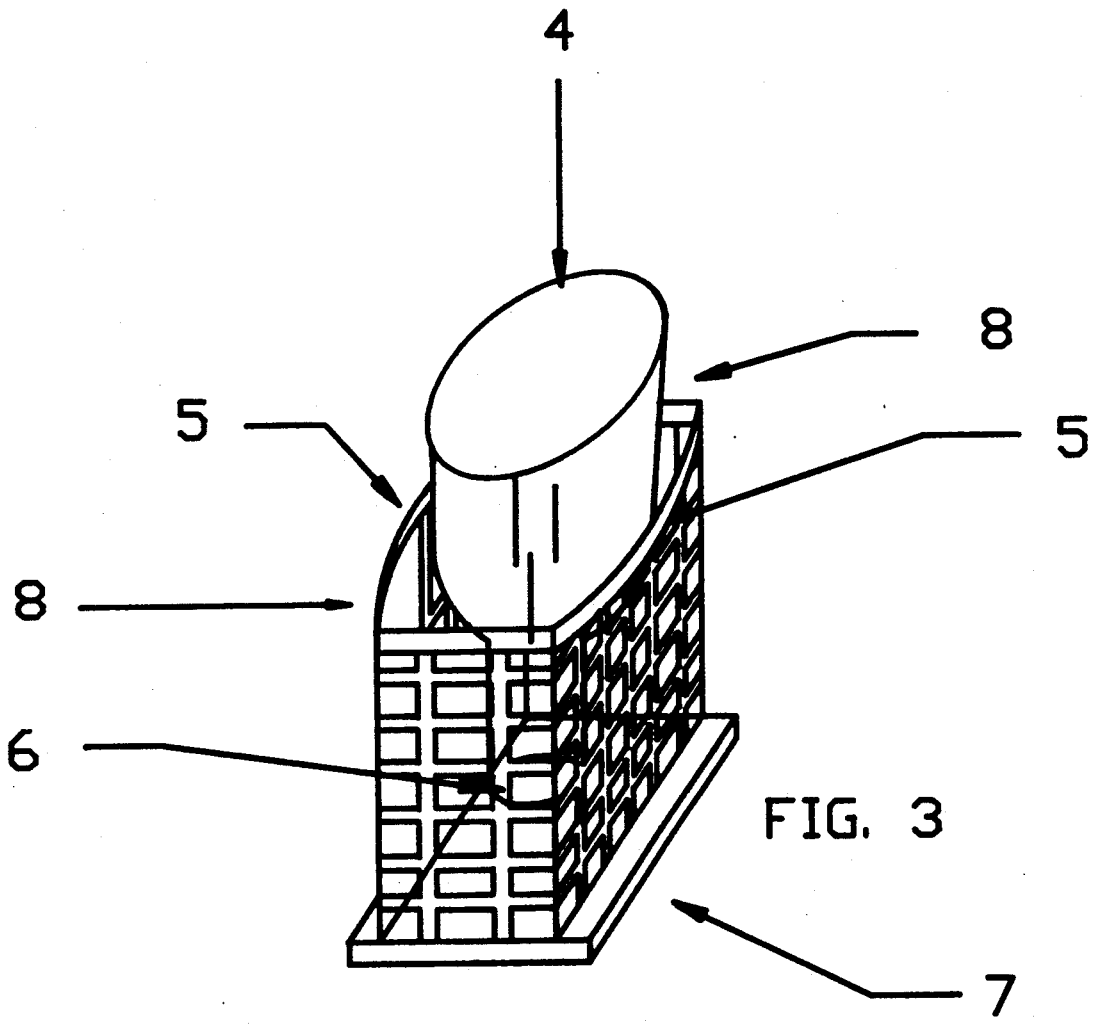
FIG. 3 is a perspective side view of a small rectangular condiment bottle placed in a flexible basket.

Our smallest condiment bottle dimension, stipulated above, is pushed into the small basket at FIG. 3 numeral 4. The long sides of the basket opening, about 1⅜ inches apart, deflect as the bottle is pushed in 5. When the bottle is pushed all the way to the bottom of the basket the bottle top seats on the basket base interior 6. The broad base 7 provides a wide enough "footprint" to keep a potentially top-heavy inverted bottled from tipping over in its basket yet is narrow enough to fit in a standard refrigerator door shelf. Even our smallest (shortest) bottle example (above) protrudes at least one inch beyond the small basket height of about 6½ inches to facilitate ease of removal. The 5½ inch width of the small basket (in the long dimension) gives small bottles plenty of "shoulder room" along their width. The extra space on either end of the basket, FIG. 3 numeral 8, allows these short sides to "buckle" slightly, helping the long sides adjust to each bottle's thickness.

Figure 4:
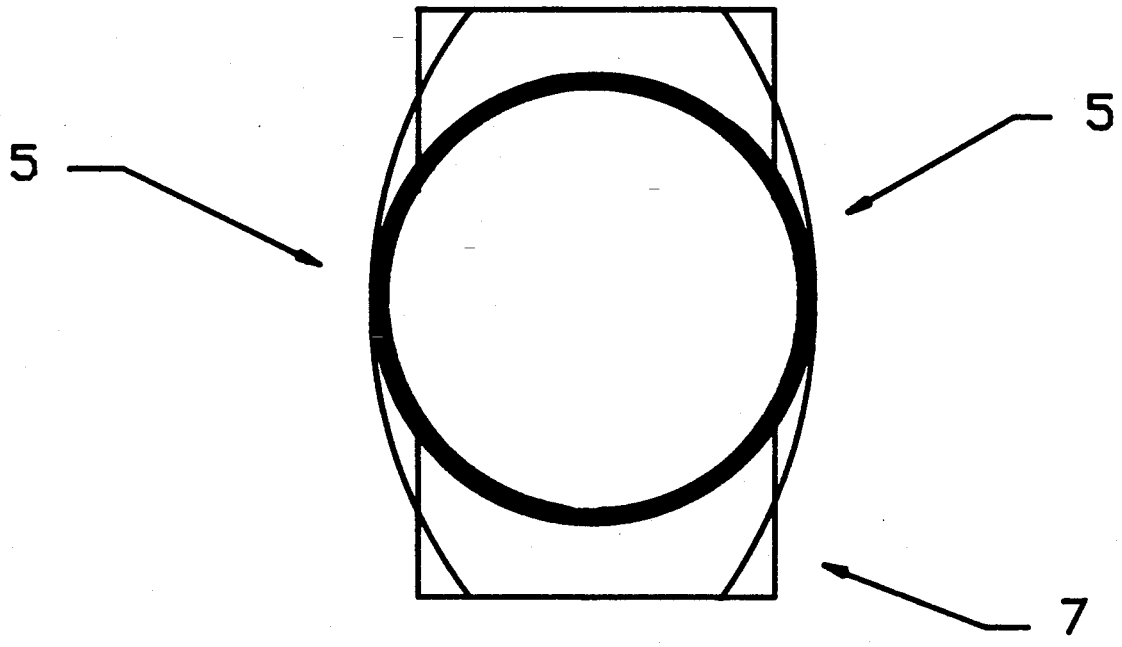
FIG. 4 is a top view of a large round condiment bottle placed in a flexible basket.

As bottle sizes graduate from small to medium (at about 2½ inches in bottle cavity thickness) the large condiment basket becomes practical to use. An opening aperture of about 2⅜ inches by 6 inches allows the basket to accommodate even the largest of the commonly found condiment bottles. In the example of FIG. 4, numeral 5 we see the top view of a round catsup bottle, nearly 4 inches in diameter, deflecting the large basket's sides slightly beyond the 3½ inch dimension of the 3½ by 6 inch base the rectangle at numeral 7.

I claim:

1. A device adapted for draining fluid materials from at least one bottle having some material remaining, including;

a base;

four side walls, two opposing side walls being of an equal long length and the two remaining opposing side walls being of an equal length shorter than the longer side walls;

said four side walls forming a basket;

said basket having an open top;

said side walls constructed of a woven flexible plastic lattice material adapted to be bendable in response to the insertion of an inverted bottle onto the open top;

the material further being sufficiently strong enough to grip and support said inverted bottle in an inverted position to enable material remaining in the bottle to drain out;

all said side walls being of a height adapted to grip bottles of standard sizes.

* * * * *